US010223965B2

(12) United States Patent
Bi et al.

(10) Patent No.: US 10,223,965 B2
(45) Date of Patent: Mar. 5, 2019

(54) SYSTEM AND METHOD FOR DATA SENSING FOR COMPENSATION IN AN ELECTRONIC DISPLAY

(71) Applicant: Apple Inc., Cupertino, CA (US)

(72) Inventors: Yafei Bi, Palo Alto, CA (US); Mohammad B. Vahid Far, San Jose, CA (US)

(73) Assignee: APPLE INC., Cupertino, CA (US)

( * ) Notice: Subject to any disclaimer, the term of this patent is extended or adjusted under 35 U.S.C. 154(b) by 44 days.

(21) Appl. No.: 15/272,170

(22) Filed: Sep. 21, 2016

(65) Prior Publication Data

US 2017/0256199 A1 Sep. 7, 2017

Related U.S. Application Data

(60) Provisional application No. 62/302,616, filed on Mar. 2, 2016.

(51) Int. Cl.

| | |
|---|---|
| ***G09G 3/3233*** | (2016.01) |
| ***G09G 3/3266*** | (2016.01) |
| ***G09G 3/3275*** | (2016.01) |
| ***G09G 3/00*** | (2006.01) |
| ***G09G 3/20*** | (2006.01) |

(52) U.S. Cl.

CPC ..... *G09G 3/3233* (2013.01); *G09G 3/006* (2013.01); *G09G 3/20* (2013.01); *G09G 3/3266* (2013.01); *G09G 3/3275* (2013.01); *G09G 2300/0819* (2013.01); *G09G 2310/0291* (2013.01); *G09G 2310/08* (2013.01); *G09G 2320/02* (2013.01); *G09G 2320/029* (2013.01); *G09G 2320/0233* (2013.01); *G09G 2330/08* (2013.01); *G09G 2330/12* (2013.01)

(58) Field of Classification Search

CPC ..... G09G 3/3233; G09G 3/3266; G09G 2330/08; G09G 2320/02; G09G 2330/12; G09G 2310/08

See application file for complete search history.

(56) References Cited

U.S. PATENT DOCUMENTS

2005/0194520 A1* 9/2005 Koseki ..... H04N 3/155 250/214 AG
2008/0198143 A1* 8/2008 Kinoshita ..... G06F 3/0412 345/175

(Continued)

FOREIGN PATENT DOCUMENTS

KR 101560492 B1 10/2015

OTHER PUBLICATIONS

International Search Report and Written Opinion for PCT Application No. PCT/US2017/018273 dated Jun. 29, 2017; 18 pgs.

*Primary Examiner* — Shaheda A Abdin
(74) *Attorney, Agent, or Firm* — Fletcher Yoder PC

(57) ABSTRACT

Provided herein are systems and methods for measurement and compensation of display panel current leakage and/or display panel noise. A pixel data signal is received at sensing and compensation circuitry. Current leakage compensation circuitry compensates for current leakage of the display panel in the data signal, while panel noise mitigation circuitry configured to reduce panel noise from the data signal. After compensating for the current leakage and reducing the panel noise, the data signal is provided to downstream circuitry for subsequent processing.

17 Claims, 15 Drawing Sheets

(56) References Cited

U.S. PATENT DOCUMENTS

| | | | | |
|---|---|---|---|---|
| 2008/0231562 | A1* | 9/2008 | Kwon | G09G 3/3233 345/77 |
| 2013/0328846 | A1* | 12/2013 | Jamal | G06F 1/3265 345/211 |
| 2016/0078805 | A1 | 3/2016 | Woo et al. | |

* cited by examiner

SYSTEM AND METHOD FOR DATA SENSING FOR COMPENSATION IN AN ELECTRONIC DISPLAY

CROSS REFERENCE TO RELATED APPLICATIONS

This application is a Non-Provisional patent application of U.S. Provisional Patent Application No. 62/302,616, entitled "SYSTEM AND METHOD FOR DATA SENSING AND COMPENSATION IN AN ELECTRONIC DISPLAY", filed Mar. 2, 2016, which are herein incorporated by reference.

BACKGROUND

This disclosure relates to sense amplifier architecture in display panels. More specifically, the current disclosure provides architectures and methods for sense amplifiers to avoid effects of panel noise and panel leakage on the sense amplifiers during operation.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Many electronic devices include electronic displays. As display resolutions increase, additional pixels may be placed within a display panel. Current leakage of the pixels in the display and panel noise of the display may result in dynamic range reduction. Current leakage in a display may be caused by many different factors. For example, the current leakage may be data dependent, the current leakage may be a result of temperature changes of the display, and the current leakage may be a result of many other factors. Further, panel noise may also result from many different factors. For example, using a single-ended sense amplifier, capacitance ratios of capacitors in a sensing channel may result in significant gain of the amplitude of panel noise signals, which may result in saturation of data signals from the pixels. As a result, the display panel may have reduced image quality.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

To improve image quality and consistency of a display, compensation circuitry may be used to counteract negative effects on pixel data caused by current leakage and panel noise within a display. In the current embodiments, lines carrying a data voltage (Vdata) may also carry the results of current leakage and panel noise to a sensing amplifier of the display. To avoid negative effects of the current leakage and panel noise when measuring the data voltage at the sensing amplifier, circuitry of a sensing channel may include components to compensate for the negative effects of the current leakage and panel noise.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

This disclosure relates to compensation for current leakage and panel noise that may occur in display panels. More specifically, the current embodiments describe techniques for mitigating effects of current leakage and panel noise when measuring data from pixels of a display panel. These techniques and measurements may be performed by a sensing channel of the display. To counter-act image degradation caused by current leakage and panel noise of the display, it may be desirable to implement compensation for the current leakage and panel noise in system architecture of a sensing channel of the display. Accordingly, as described in detail below, various architectures and methods relating to a sensing amplifier of the display may be used to negate the effects of the current leakage and panel noise in the display.

Figure 1:
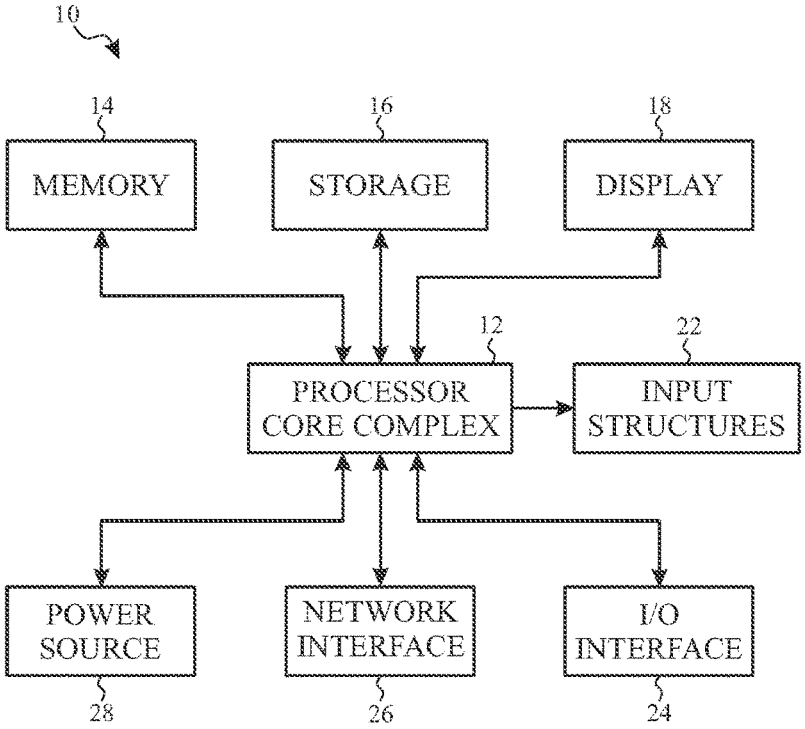
FIG. 1 is a schematic block diagram of an electronic device including a display, in accordance with an embodiment.

Turning first to FIG. 1, an electronic device 10 according to an embodiment of the present disclosure may include, among other things, a processor core complex 12 having one or more processor(s), memory 14, nonvolatile storage 16, a display 18, input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

Figure 2:
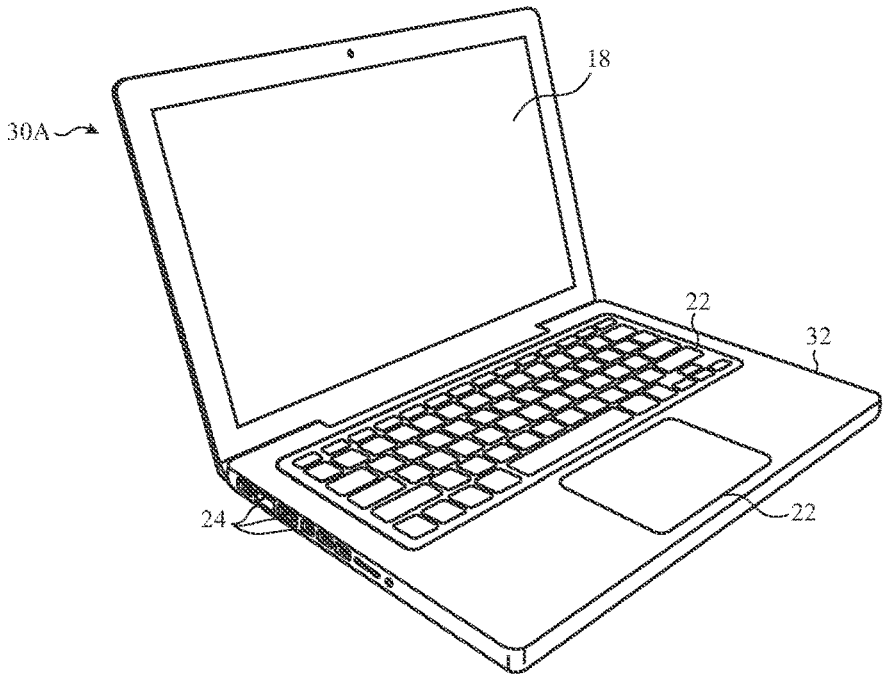
FIG. 2 is a perspective view of a notebook computer representing an embodiment of the electronic device of FIG. 1, in accordance with an embodiment.
Figure 3:
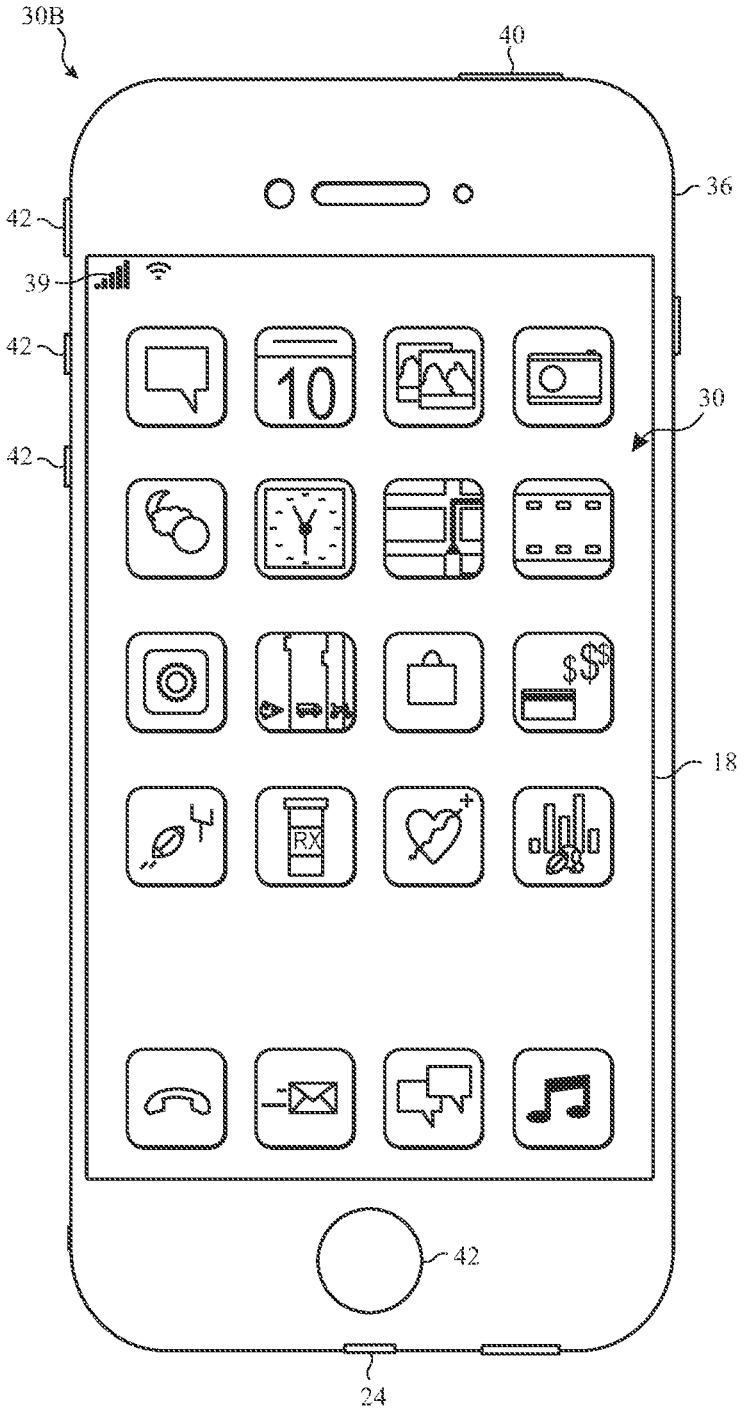
FIG. 3 is a front view of a hand-held device representing another embodiment of the electronic device of FIG. 1, in accordance with an embodiment.
Figure 4:
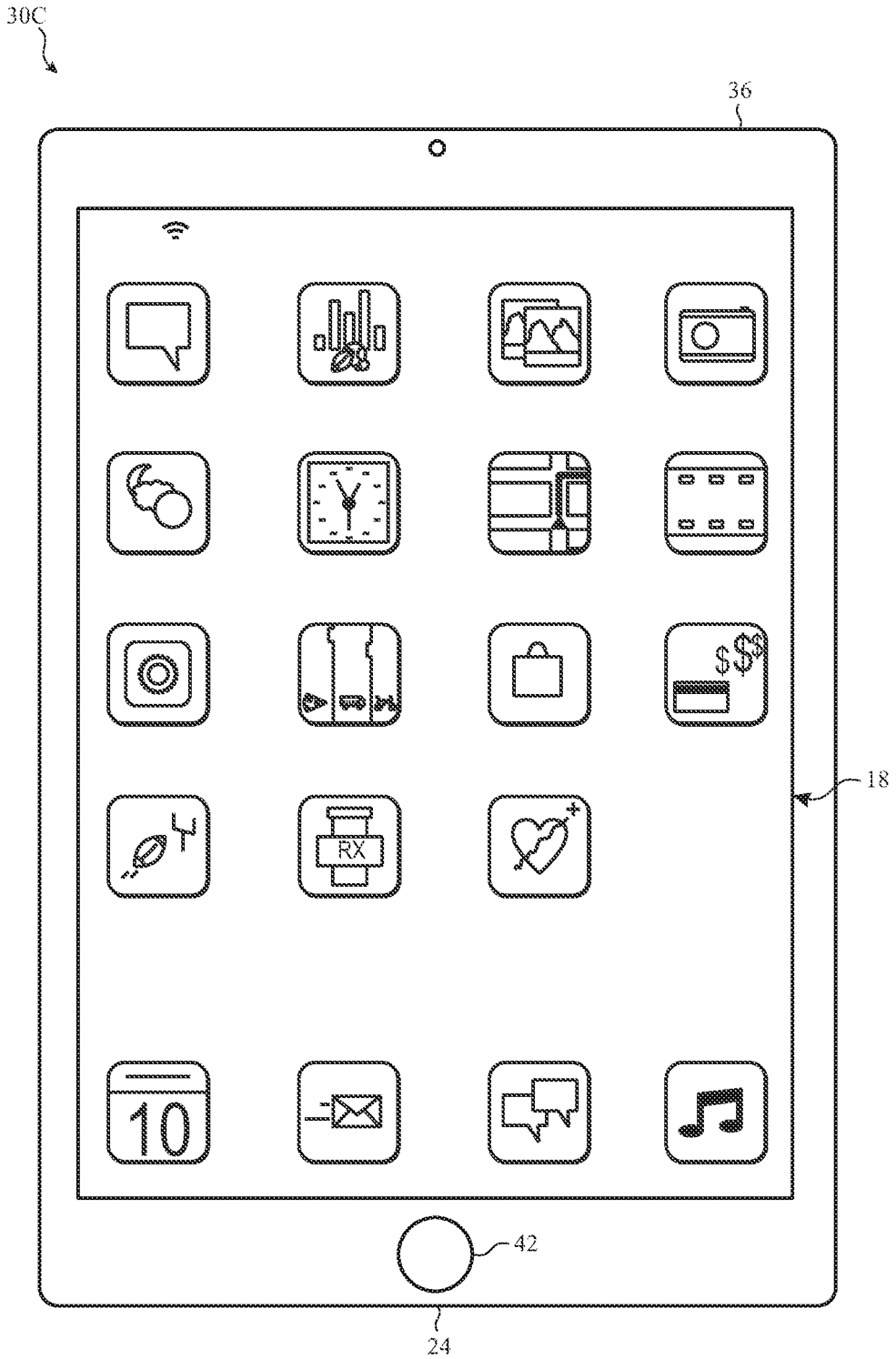
FIG. 4 is a front view of another hand-held device representing another embodiment of the electronic device of FIG. 1, in accordance with an embodiment.
Figure 5:
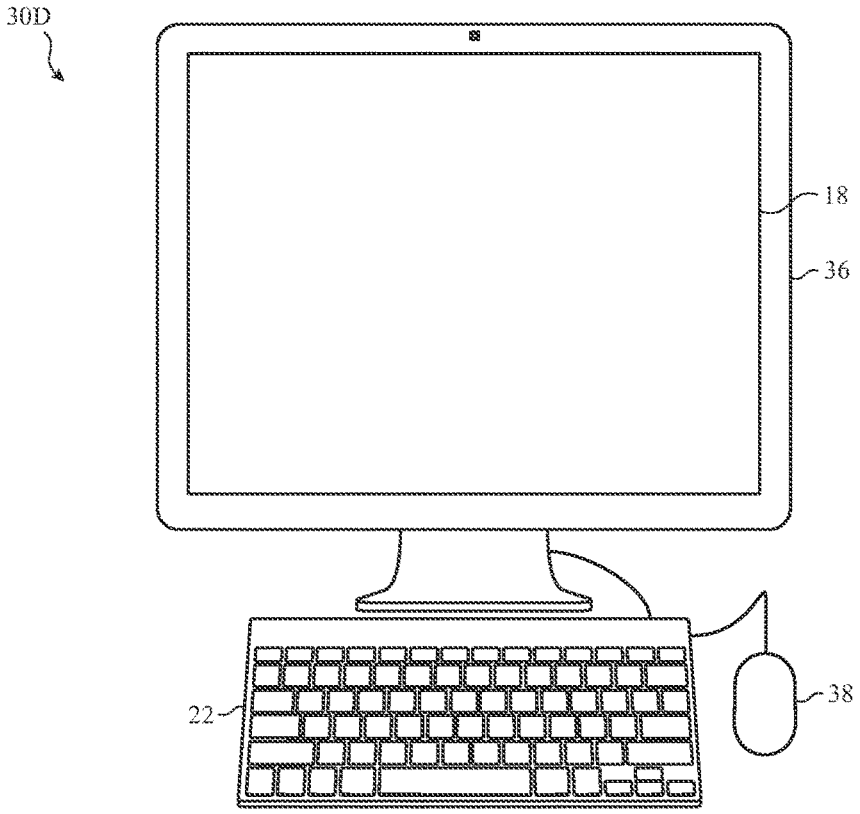
FIG. 5 is a front view of a desktop computer representing another embodiment of the electronic device of FIG. 1, in accordance with an embodiment.
Figure 6:
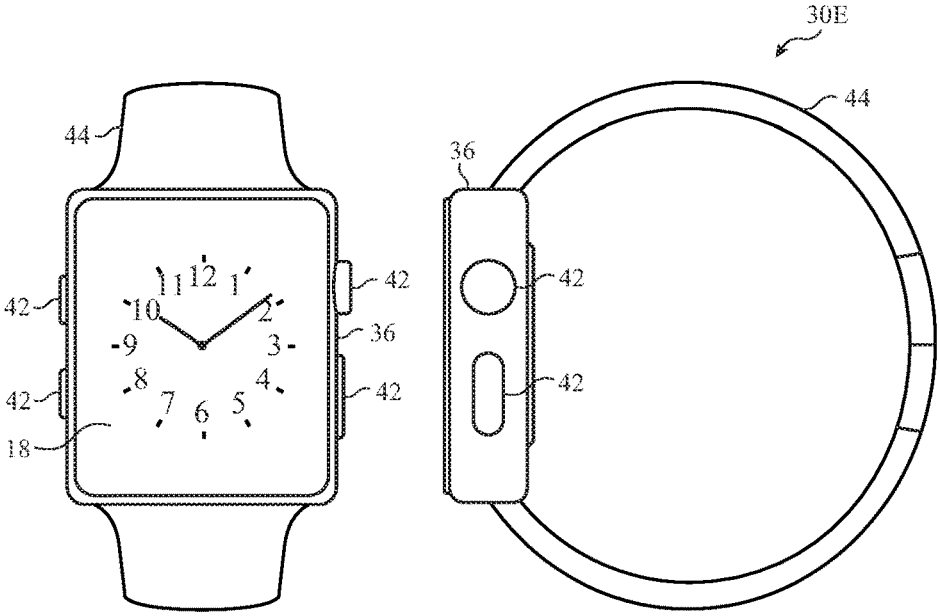
FIG. 6 is a front view of a wearable electronic device representing another embodiment of the electronic device of FIG. 1, in accordance with an embodiment.

By way of example, the electronic device 10 may represent a block diagram of the notebook computer depicted in FIG. 2, the handheld devices depicted in FIGS. 3 and 4, the desktop computer depicted in FIG. 5, the wearable electronic device depicted in FIG. 6, or similar devices. It should be noted that the processor core complex 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor core complex 12 and/or other data processing circuitry may be operably coupled with the memory 14 and the nonvolatile storage 16 to perform various algorithms. Such programs or instructions executed by the processor core complex 12 may be stored in any suitable article of manufacture that may include one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor core complex 12 to enable the electronic device 10 to provide various functionalities.

As will be discussed further below, the display 18 may include pixels such as organic light emitting diodes (OLEDs), micro-light-emitting-diodes (μ-LEDs), or any other light emitting diodes (LEDs). Further, the display 18 is not limited to a particular pixel type, as the circuitry and methods disclosed herein may apply to any pixel type. Accordingly, while particular pixel structures may be illustrated in the present disclosure, the present disclosure may relate to a broad range of lighting components and/or pixel circuits within display devices.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a $3^{rd}$ generation (3G) cellular network, $4^{th}$ generation (4G) cellular network, or long term evolution (LTE) cellular network. The network interface 26 may also include interfaces for, for example, broadband fixed wireless access networks (WiMAX), mobile broadband Wireless networks (mobile WiMAX), asynchronous digital subscriber lines (e.g., 15SL, VDSL), digital video broadcasting-terrestrial (DVB-T) and its extension DVB Handheld (DVB-H), ultra Wideband (UWB), alternating current (14) power lines, and so forth.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 22, and ports of an I/O interface 24. In one embodiment, the input structures 22 (such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 30B may represent, for example, a portable phone, a media player, a personal data organizer, a handheld game platform, or any combination of such devices. By way of example, the handheld device 30B may be a model of an iPod® or iPhone® available from Apple Inc. of Cupertino, Calif.

The handheld device 30B may include an enclosure 36 to protect interior components from physical damage and to shield them from electromagnetic interference. The enclosure 36 may surround the display 18, which may display indicator icons 39. The indicator icons 39 may indicate, among other things, a cellular signal strength, Bluetooth connection, and/or battery life. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 40 and 42, in combination with the display 18, may allow a user to control the handheld device 30B. For example, the input structure 40 may activate or deactivate the handheld device 30B, the input structure 42 may navigate user interface to a home screen, a user-configurable application screen, and/or activate a voice-recognition feature of the handheld device 30B, the input structures 42 may provide volume control, and/or may toggle between vibrate and ring modes.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (PC) by another manufacturer. A similar enclosure 36 may be provided to protect and enclose internal components of the computer 30D such as the display 18. In certain embodiments, a user of the computer 30D may interact with the computer 30D using various peripheral input devices, such as the input structures 22 or mouse 38, which may connect to the computer 30D via a wired and/or wireless I/O interface 24.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 44, may be an Apple Watch® by Apple, Inc. However, in other embodiments, the wearable electronic device 30E may include any wearable electronic device such as, for example, a wearable exercise monitoring device (e.g., pedometer, accelerometer, heart rate monitor), or other device by another manufacturer. The display 18 of the wearable electronic device 30E may include a touch screen, which may allow users to interact with a user interface of the wearable electronic device 30E.

Figure 7:
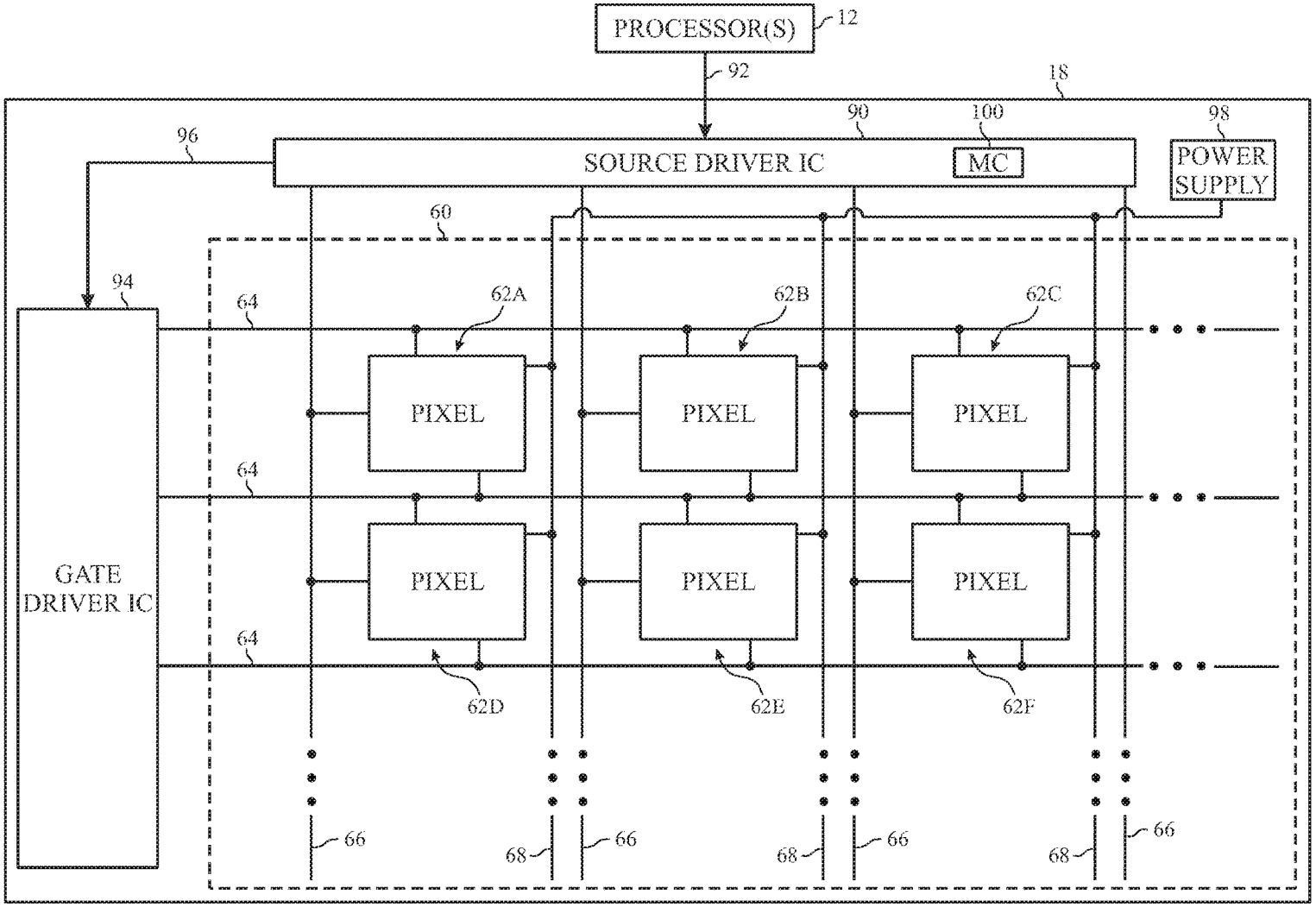
FIG. 7 is a circuit diagram illustrating a portion of a matrix of pixels of the display of FIG. 1, in accordance with an embodiment.

The display 18 for the electronic device 10 may include a matrix of pixels that contain light emitting circuitry. Accordingly, FIG. 7 illustrates a circuit diagram including a portion of a matrix of pixels of the display 18. As illustrated, the display 18 may include a display panel 60. Moreover, the display panel 60 may include multiple unit pixels 62 (here, six unit pixels 62A, 62B, 62C, 62D, 62E, and 62F are shown) arranged as an array or matrix defining multiple rows and columns of the unit pixels 62 that collectively form a viewable region of the display 18 in which an image may be displayed. In such an array, each unit pixel 62 may be defined by the intersection of rows and columns, represented here by illustrated gate lines 64 (also referred to as "scanning lines") and data lines 66 (also referred to as "source lines"), respectively. Additionally, power supply lines 68 may provide power to each of the unit pixels 62.

Although only six unit pixels 62 are shown, it should be understood that in an actual implementation, each data line 66 and gate line 64 may include hundreds or even thousands of such unit pixels 62. By way of example, in a color display panel 60 having a display resolution of 1024×768, each data line 66, which may define a column of the pixel array, may include 768 unit pixels, while each gate line 64, which may define a row of the pixel array, may include 1024 groups of unit pixels with each group including a red, blue, and green pixel, thus totaling 3072 unit pixels per gate line 64. By way of further example, the panel 60 may have a resolution of 480×320 or 960×640. In the presently illustrated example, the unit pixels 62 may represent a group of pixels having a red pixel (62A), a blue pixel (62B), and a green pixel (62C). The group of unit pixels 62D, 62E, and 62F may be arranged in a similar manner. Additionally, in the industry, it is also common for the term "pixel" to refer to a group of adjacent different-colored pixels (e.g., a red pixel, blue pixel, and green pixel), with each of the individual colored pixels in the group being referred to as a "sub-pixel."

The display 18 also includes a source driver integrated circuit (IC) 90, which may include a chip, such as a processor or ASIC, configured to control various aspects of the display 18 and panel 60. For example, the source driver IC 90 may receive image data 92 from the processor(s) 12 and send corresponding image signals to the unit pixels 62 of the panel 60. The source driver IC 90 may also be coupled to a gate driver IC 94, which may be configured to provide/remove gate activation signals to activate/deactivate rows of unit pixels 62 via the gate lines 64. The source driver IC 90 may include a timing controller that determines and sends timing information to the gate driver IC 94 to facilitate activation and deactivation of individual rows of unit pixels 62. In other embodiments, timing information may be provided to the gate driver IC 94 in some other manner (e.g., using a timing controller that is separate from the source driver IC 90). Further, while FIG. 7 depicts only a single source driver IC 90, it should be appreciated that other embodiments may utilize multiple source driver ICs 90 to provide image signals 96 to the unit pixels 62. For example, additional embodiments may include multiple source driver ICs 90 disposed along one or more edges of the panel 60, with each source driver IC 90 being configured to control a subset of the data lines 66 and/or gate lines 64.

In operation, the source driver IC 90 receives image data 92 from the processor 12 or a discrete display controller and, based on the received data, outputs signals to control the unit pixels 62. When the unit pixels 62 are controlled by the source driver IC 90, circuitry within the unit pixels 62 may complete a circuit with a power supply 98 and light elements of the unit pixels 62. Additionally, to measure data provided to the unit pixels 62, measurement circuitry 100 may be positioned within the source driver IC 90 to read data of the unit pixels 62, as discussed in detail below.

Figure 8:
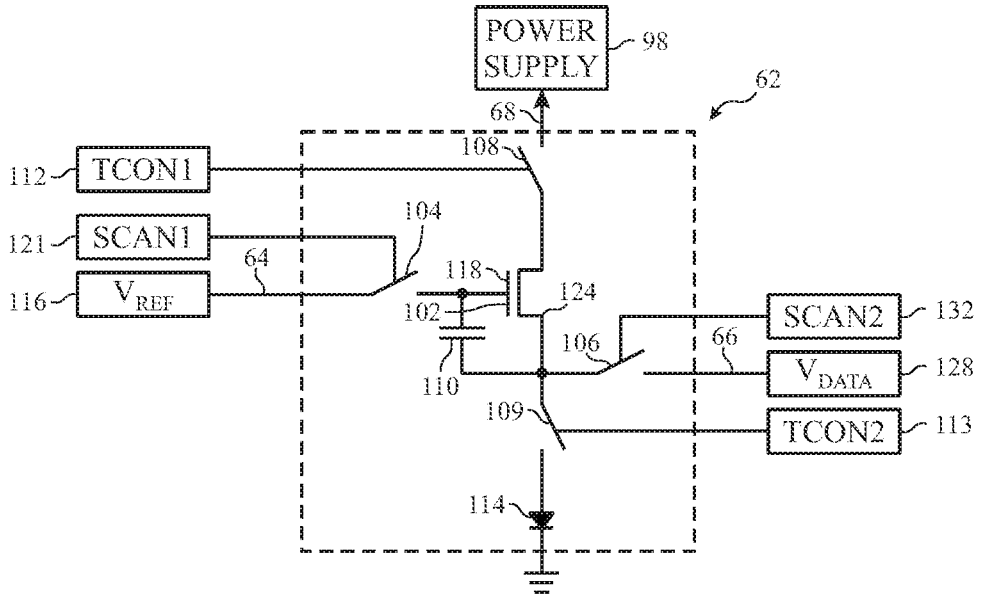
FIG. 8 is a circuit diagram illustrating a light emitting diode pixel capable of operating in the matrix of pixels of FIG. 7, in accordance with an embodiment.

With this in mind, FIG. 8 is a schematic diagram of the unit pixel 62 in the display 18. The unit pixel 62 includes a driving thin-film transistor (TFT) 102, two scanning switches 104 and 106, two emitter switches 108 and 109, and a storage capacitor 110. In the illustrated embodiment, the source emitter switch 108 may couple between the power supply 98 and the driving TFT 102, and the source emitter switch 109 may couple between the driving TFT 102 and a light source 114. In this manner, the emitter switches 108 and 109, which may receive control signals from timing controllers TCON 1 112 and TCON 2 113, respectively, control the application of the power supply 98 to the driving TFT 102 and the light source 114. In other embodiments, the unit pixel 62 may include a single emitter switch 108 or 109 that controls application of the power supply 98 to the driving TFT 102 and/or the light source 114. Additionally, when the emitter switches 108 and 109 are closed, the driving TFT 102 controls the application of the power supply 98 to the light source 114. Furthermore, the scanning switch 104 may be electrically coupled between the gate line 64, which carries a reference voltage ($V_{REF}$) 116, and a gate 118 of the driving TFT 102. The scanning switch 104 may be controlled by a first scanning signal 121 from the gate driver IC 94. Each of the switches 102, 104, 106, and 108 function as switching elements within the unit pixel 62 and may be activated and deactivated (e.g., switched on and off) for a predetermined period based upon the respective presence or absence of an activation signal (also referred to as a scanning signal) at control inputs of the switches 102, 104, 106, and 108.

Furthermore, a storage capacitor 110 may be electrically coupled to the gate 118 of the driving TFT 102 and a drain 124 of the driving TFT 102. The scanning switch 106 may be electrically coupled between a data voltage ($V_{DATA}$) source 128 and the emitter switch 109. Further, the scanning switch 106 may be controlled by a second scanning signal 132 from the gate driver IC 94.

To display the image data 92, the source driver IC 90 and the gate driver IC 94, as depicted in FIG. 7, may respectively supply voltage to the scanning switch 104 to charge the storage capacitor 110. The storage capacitor 110 may drive the gate 118 of the driving TFT 102 to provide a current from the power supply 98 to the light source 114 of the unit pixel 62. As may be appreciated, the color of a particular unit pixel depends on the color of the corresponding light source 114. The above-described process may be repeated for each row of pixels 62 in the panel 60 to reproduce image data 92 as a viewable image on the display 18. Additionally, it may be appreciated that while FIG. 8 depicts a generic light source 114, any type of lighting element may also be used as the light source 114 for the methods described herein.

By way of example, the first scanning signal 121 may generally control when the reference voltage 116 is applied to the driving TFT 102, and, in turn, when the power supply 98 is supplied to the light source 114. Additionally, the second scanning signal 132 may generally control when the capacitor 110 and the light source 114 couple to the data line 66. Through control of the switches 102, 104, 106, and 108, the measurement circuitry 100 may observe various operating parameters of the unit pixels 62, as discussed in detail below.

Figure 9:
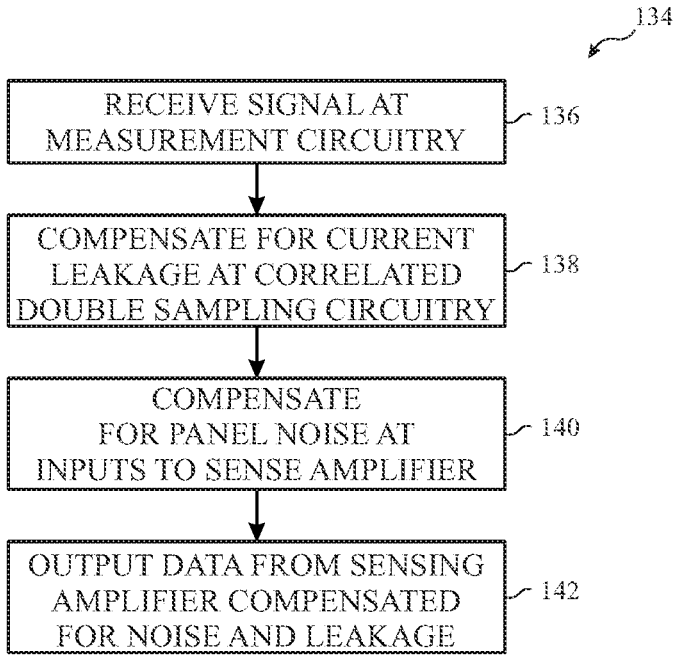
FIG. 9 is a flow chart describing a compensation scheme for current leakage and panel noise when measuring current of a data signal provided to the matrix of pixels in FIG. 7, in accordance with an embodiment.

Turning now to FIG. 9, a flow chart describing a method 134 of a compensation scheme for current leakage and panel noise when measuring current of data signals from the unit pixels 62 is illustrated. Initially, at block 136, a data signal is received at the measurement circuitry 100. The measurement circuitry 100 may include a sensing channel, as described in detail below, that senses the data signal from a unit pixel 62, and amplifies the data signal to a usable value.

At block 138, compensation for current leakage of the panel 60 may occur at correlated double sampling circuitry of the measurement circuitry 100. Current leakage may result in dynamic range reduction of an analog front end of the display 18 due to an increased amount of headroom resulting from the current leakage during operation of the display 18. Accordingly, the current leakage of the panel 60 may be distinguished from a pixel current, and the current leakage compensated for by the correlated double sampling circuitry to limit the dynamic range reduction of the analog front end. Additionally, the current leakage may be data dependent, and the current leakage may be temperature dependent. Therefore, because the current leakage may vary during operation of the panel 60, the correlated double sampling circuitry may continuously limit any negative effects on the data signals from the unit pixels 62 during operation of the display 18.

Further, at block 140, compensation for panel noise at inputs to a sense amplifier of the sensing channel may be performed. Circuitry of the sensing channel, as described in greater detail below, may result in amplification of panel noise. The amplification of panel noise may also result in an increase in voltage headroom during operation of the display 18, which may result in a reduction of the dynamic range of the analog front end. When the panel noise is amplified to a level that approaches a data signal, the sensing amplifier may be saturated by the panel noise resulting in data that is unusable. Therefore, the data signals may be increased to avoid interference from the panel noise, which would result in increased voltage headroom. Alternatively, a compensation scheme to mitigate panel noise may be used, as in block 140. Accordingly, the sensing channel may compensate for the panel noise by introducing signals that counter the panel noise signals while avoiding an increase in voltage headroom.

At block 142, usable data may be output from the sensing amplifier to an analog to digital converter. The usable data may be compensated for both panel noise and current leakage, as discussed above in relation to blocks 138 and 140. In compensating for the panel noise and current leakage, voltage headroom is reduced resulting in an increase in the dynamic range of the analog front end, and an error of the data measurement may be limited to approximately 1% of the value of the data measurement.

Figure 10:
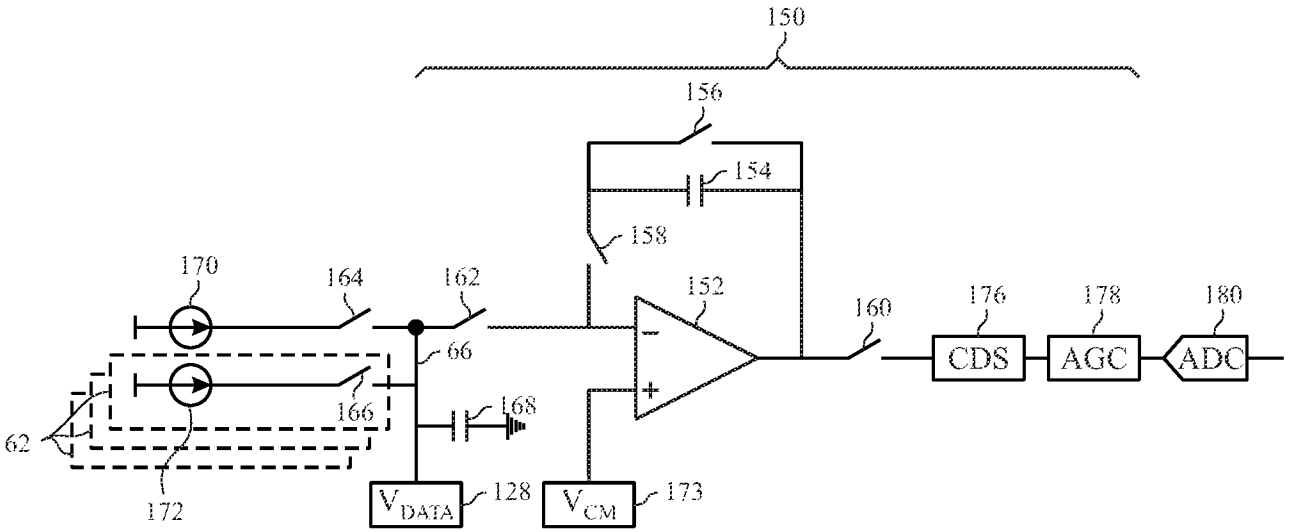
FIG. 10 is a schematic diagram of a sensing channel of the matrix of pixels of FIG. 7, in accordance with an embodiment.

To help illustrate the method 134 presented in FIG. 9, FIG. 10 is a schematic diagram of a sensing channel 150 of the matrix of pixels 62. The sensing channel 150 may include a sensing amplifier 152 and an integrating capacitor 154. The sensing amplifier 152 and the integrating capacitor 154 function together as an amplifier integrator capable of producing a signal that is representative of a current coming from the unit pixel 62. Further, the sensing channel 150 may include several switches 156, 158, 160, 162, 164, and 166. The switches may perform various functions such as resetting the integrating capacitor 154 and programming the capacitor 154, as described in greater detail below. Further, the data voltage source 128 may be fed into a negative terminal of the sensing amplifier 152 when the switch 162 is closed. A line capacitor 168 may be coupled between the data line 66 of the data voltage source 128 and ground. A capacitance of the line capacitor 168 may be in range of 10 pF-100 pF, which may be approximately 100-1000 times larger than a capacitance of the integrating capacitor 154.

The negative terminal of the sensing amplifier may also receive pixel current 170 when the switch 164 is closed and/or current leakage 172 when the switch 166 is closed. Further, a positive terminal of the sensing amplifier 152 may receive voltage from a comparison voltage ($V_{CM}$) 173. An output of the sensing amplifier 152 may be provided to correlated double sampling circuitry 176 via the switch 160. The correlated double sampling circuitry 176 may compensate for the current leakage 172 that is provided to the negative terminal of the sensing amplifier 152 during operation of the sensing channel 150. From the correlated double sampling circuitry 176, the compensated output of the sensing amplifier 152 may be provided to automatic gain control circuitry 178 that controls a gain of the signal to an appropriate level for an analog to digital converter 180. The resulting digital signal represents a value of the pixel current that may be used by the processor 12 to compensate for variations resulting from threshold voltages of the driving TFT 102 for each pixel.

Figure 11:
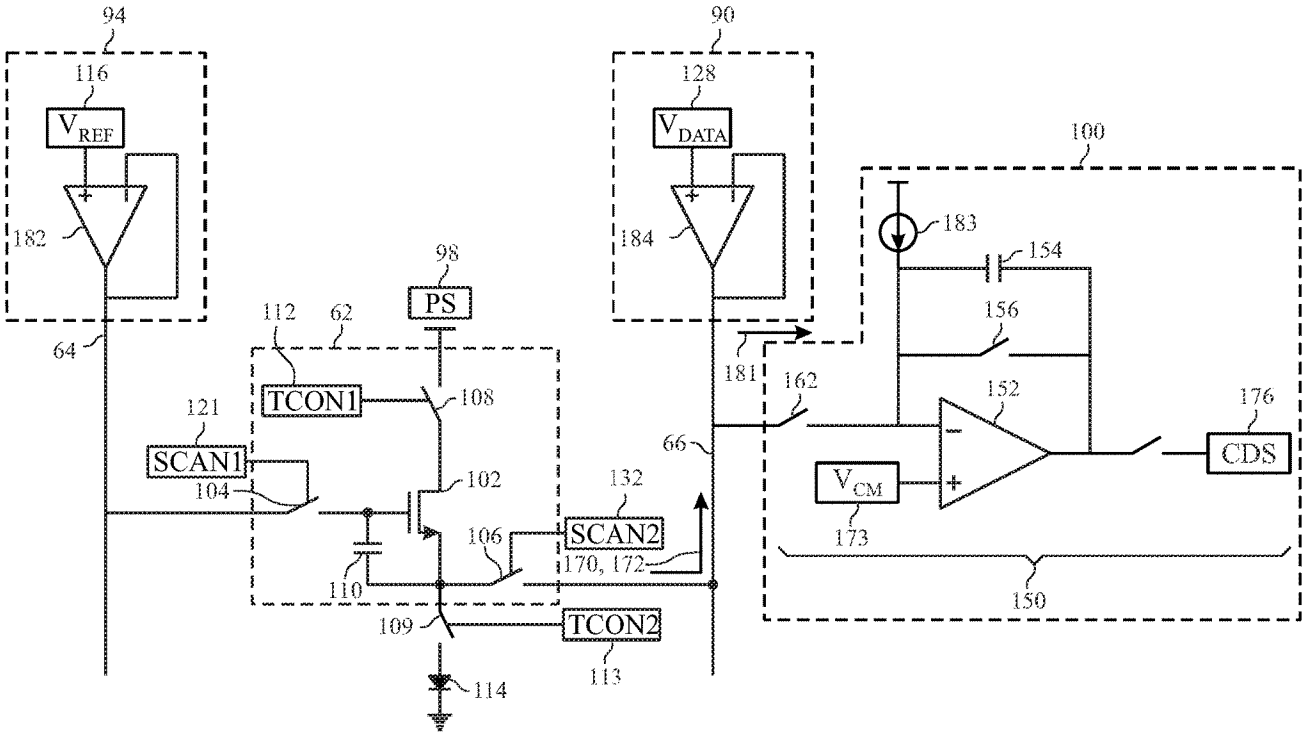
FIG. 11 is a schematic diagram of a pixel and a portion of a sensing channel of the matrix of pixels of FIG. 7, in accordance with an embodiment.

FIG. 11 is a schematic diagram of a unit pixel 62 and a portion of the sensing channel 150. As depicted, the reference voltage source 116 is amplified by an amplifier 182 within the gate driver IC 94. Similarly, the data voltage source 128 is amplified by an amplifier 184 within the source driver IC 90. Further, the sensing channel 150 is shown as a portion of the measurement circuitry 100. In some embodiments, the measurement circuitry 100 may be included within the source driver IC 90, or, in other embodiments, the measurement circuitry 100 may be separate from the source driver IC 90. Furthermore, as depicted in FIG. 11, current leakage of the panel 60 that is compensated by the correlated double sampling circuitry 176 is represented by the current leakage source 172 from the pixel 62, and the pixel current 170 may also be provided to the sensing amplifier from the unit pixel 62. Moreover, a calibration current source 183 is also provided to a sense path 181 of the sensing amplifier 152. The calibration current source 183 provides calibration of the sense path 181 to compensate for gain and offset resulting from component mismatch in each of the sensing channels 150.

Turning now to FIGS. 12-15, a method 185 is depicted including three stages for accomplishing compensation of the current leakage 172 using the correlated double sampling circuitry 176. For example, at block 186 of FIG. 12 and illustrated in FIG. 13, a programming stage of the sensing channel 150 is performed. The programming stage is used to program the integrating capacitor 154 and the line capacitor 168 from the data voltage source 128. To program the capacitors 154 and 168, the switches 156, 158, and 162 may be closed while the switches 160, 164, and 166 remain open. Upon closing the switches, the integrating capacitor 154 discharges and the line capacitor 168 charges to a voltage equal to the voltage of the data voltage source 128.

Figure 12:
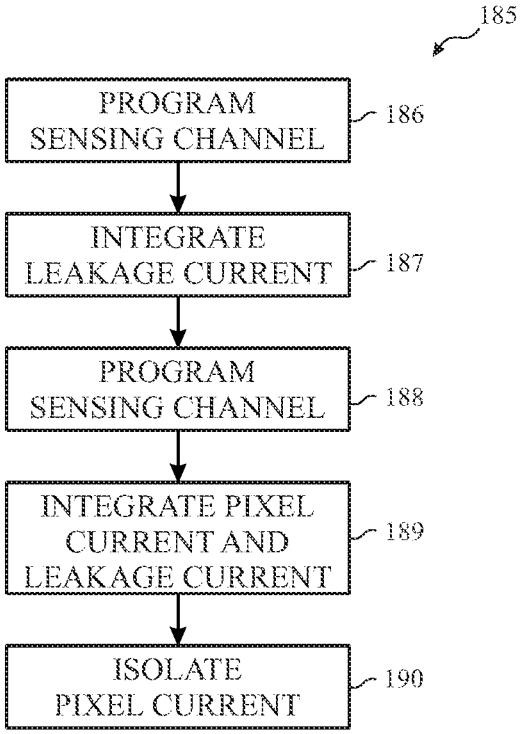
FIG. 12 is a flow chart describing method of a compensation scheme for current leakage when measuring current of a data signal provided to the matrix of pixels of FIG. 7.
Figure 14:
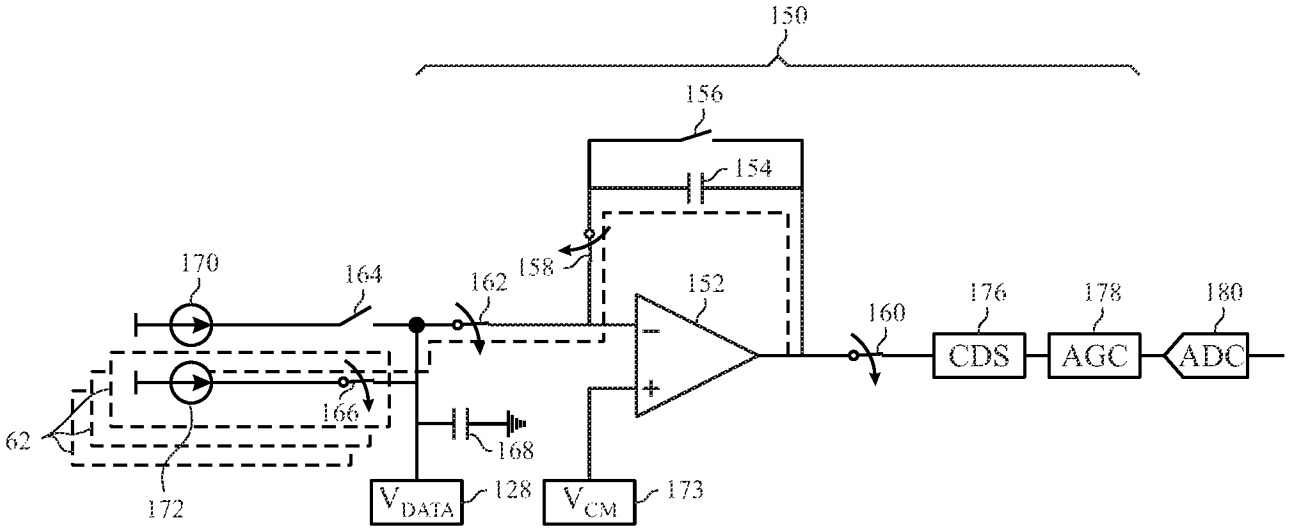
FIG. 14 is a schematic diagram of the sensing channel of FIG. 10 during a current leakage integration phase of the method of FIG. 12, in accordance with an embodiment.
Figure 15:
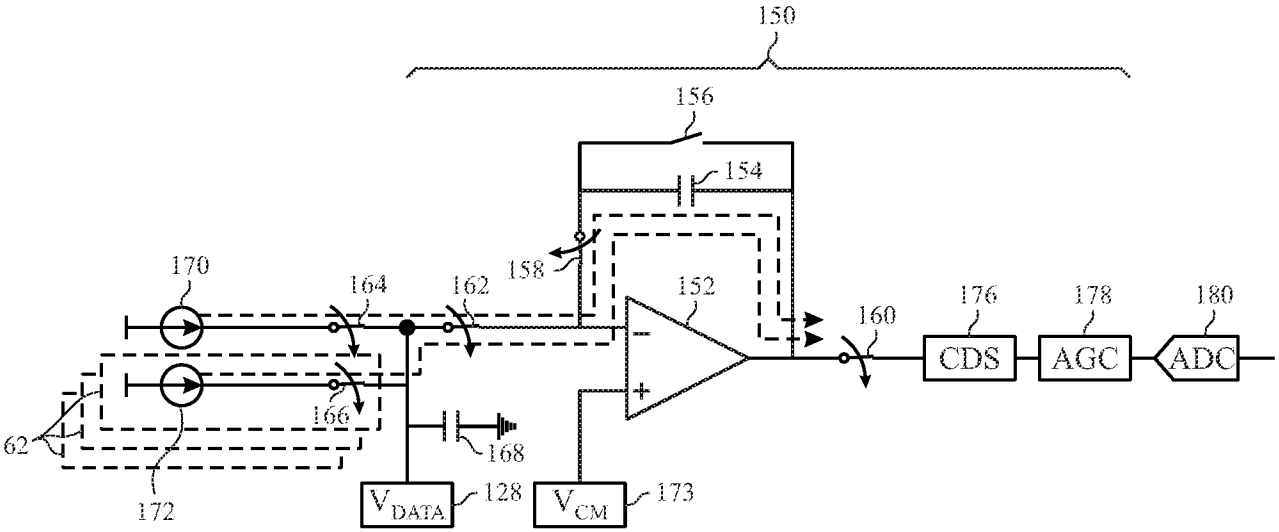
FIG. 15 is a schematic diagram of the sensing channel of FIG. 10 during a pixel current and current leakage integration phase of the method of FIG. 12, in accordance with an embodiment.

Once the sensing channel 150 is programmed, at block 187 of FIG. 12 and illustrated in FIG. 14, the integration of the current leakage 172 at the sensing amplifier 152 and the integrating capacitor 154 is performed. To accomplish the integration of the current leakage 172, the switches 158, 162, 166, and 160 are closed while the switches 156 and 164 are opened. The resulting output, which is a signal representative of the current leakage 172, of the sensing amplifier 152 is then provided to the correlated double sampling circuitry 176.

Figure 13:
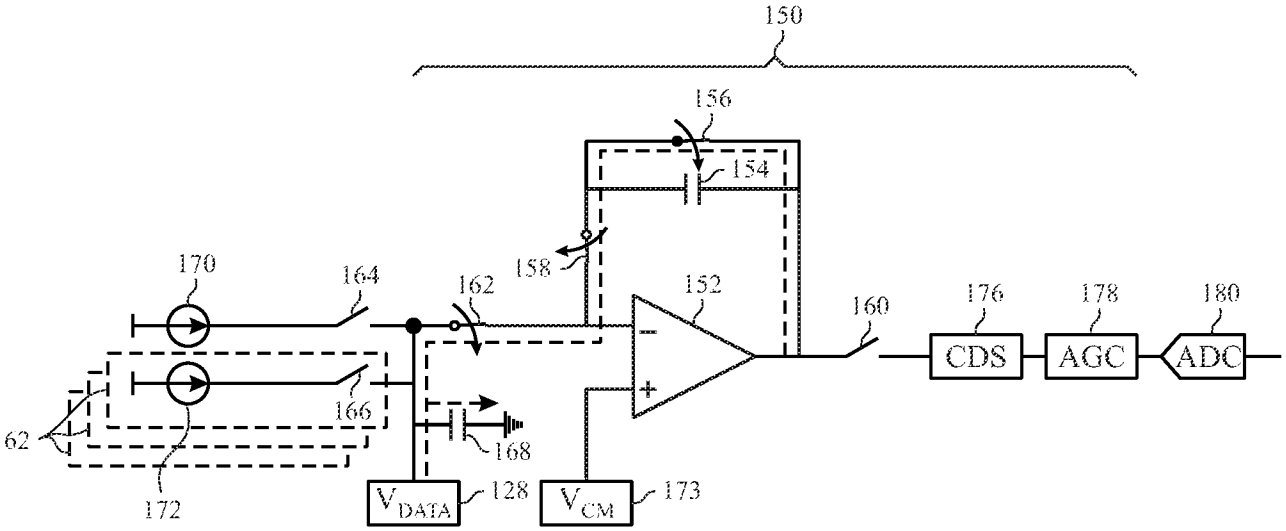
FIG. 13 is a schematic diagram of the sensing channel of FIG. 10 during a programming phase of the method of FIG. 12, in accordance with an embodiment.

Subsequently, at block 188 of FIG. 12 and illustrated in FIG. 13, the sensing channel 150 is reprogrammed by closing switches 156, 158, and 162 and opening switches 160, 164, and 166. Once reprogramming is accomplished, at block 189 of FIG. 12 and illustrated in FIG. 14, integration of the current leakage 172 and the pixel current 170 by the sensing amplifier 152 and the integrating capacitor 154 is performed. To accomplish the integration of the current leakage 172 and the pixel current 170, switches 158, 160, 162, 164, and 166 are all closed and switch 156 is opened. The resulting output, which is a signal representative of both the current leakage 172 and the pixel current 170, is provided to the correlated double sampling circuitry 176. Subsequently, at block 190 of FIG. 12, the correlated double sampling circuitry 176 may remove the value of the current leakage 172 measured in FIG. 14 from the value of the combination of the current leakage 172 and the pixel current 170 measured in FIG. 15 to isolate only the value of the pixel current 170 to provide to the automatic gain control circuitry 178 and the analog to digital converter 180. In this manner, the sensing channel 150 is able to compensate for any current leakage 172 that may be experienced by the panel 60 of the display 18. Further, compensating for the current leakage 172 may decrease or remove headroom that was previously occupied by the current leakage 172 to bolster the dynamic range of the analog front end of the display 18.

Figure 16:
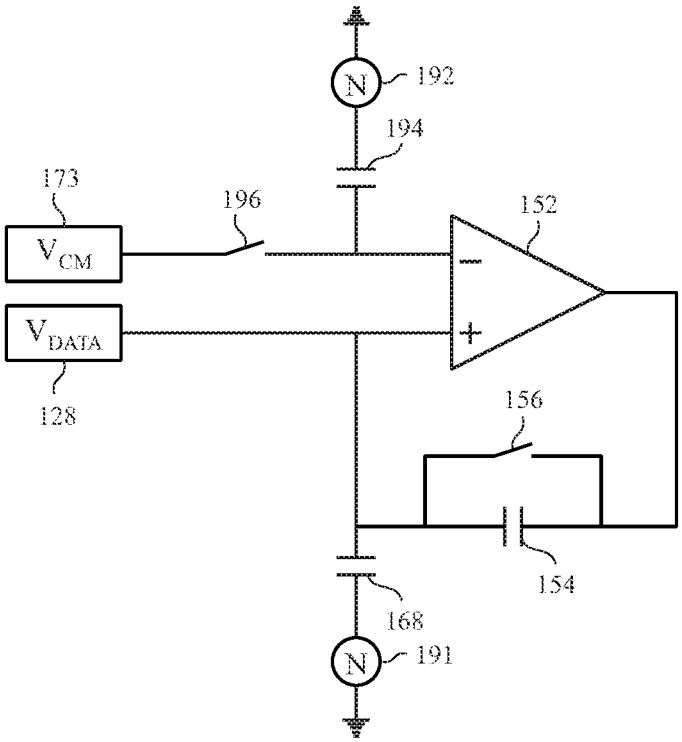
FIG. 16 is a schematic diagram of a portion of the sensing channel of FIG. 10 that compensates for panel ground noise, in accordance with an embodiment.

Turning now to FIG. 16, a portion of the sensing channel 150 that compensates for panel ground noise is depicted. A ratio of the capacitance of the line capacitor 168 and the capacitance of the integrating capacitor 154 determines a gain on panel ground noise 191. For example, the gain may be equal to the capacitance of the line capacitor 168 divided by the capacitance of the integrating capacitor 154. Because the line capacitor 168 has a relatively large capacitance compared to the integrating capacitor 154, the gain on the panel ground noise 191 that is provided to the negative terminal of the sensing amplifier 152 is large. For example, the capacitance of the line capacitor 168 may be approximately 50 pF while the capacitance of the integrating capacitor 154 may be approximately 0.5 pF. In such a situation, the gain on the panel ground noise 191 may be 100 times the original value of the panel ground noise 191. Assuming a gain of 100 and noise of 10 mV, the resulting signal may be 1 V, which would saturate the sensing amplifier 152. That is, the panel ground noise 191 may be amplified to the point where the noise acts as the signal.

To mitigate the panel ground noise 191 amplified by the capacitor mismatch, an additional panel ground noise 192 and an additional line capacitor 194 may be added to the positive terminal of the sensing amplifier 152, as illustrated in FIG. 16. The additional line capacitor 194 may have the same capacitance as the line capacitor 168, and the additional panel ground noise 192 may be similar to the panel ground noise 191, but the additional panel ground noise 192 may include a 180 degree phase shift from the panel ground noise 191. In this manner, the gain of the panel ground noise 191 and the additional panel ground noise 192 may be similar, but the phase offset may result in a common mode signal at the input of the sensing amplifier 152. Due to the 180 degree phase offset, the panel ground noise 191 and the additional panel noise 192 cancel each other out during the integration process of the sensing amplifier 152 and the integrating capacitor 154.

To accomplish this mitigation of the panel ground noise 191, during a reset period of the sensing channel 150, the switch 156 and switch 196 are closed. In closing the switch 196, the additional line capacitor 194 is charged to the value of the comparison voltage 173. During operation, the switches 156 and 196 are opened, but the additional line capacitor 194 maintains the charge of the comparison voltage 173. Because the additional line capacitor 194 is not coupled to any components other than the additional panel ground noise 192 and the positive terminal of the sensing amplifier 152 during operation, any change resulting from the additional panel ground noise 192 will be input to the positive terminal of the sensing amplifier 152. On the negative input of the sensing amplifier 152, the data measurement from the data voltage source 128 and the panel ground noise 191 are applied. The resulting output of the sensing amplifier 152 cancels out the panel ground noises 191 and 192. Accordingly, additional headroom for the panel ground noise 191 may be avoided.

Figure 17:
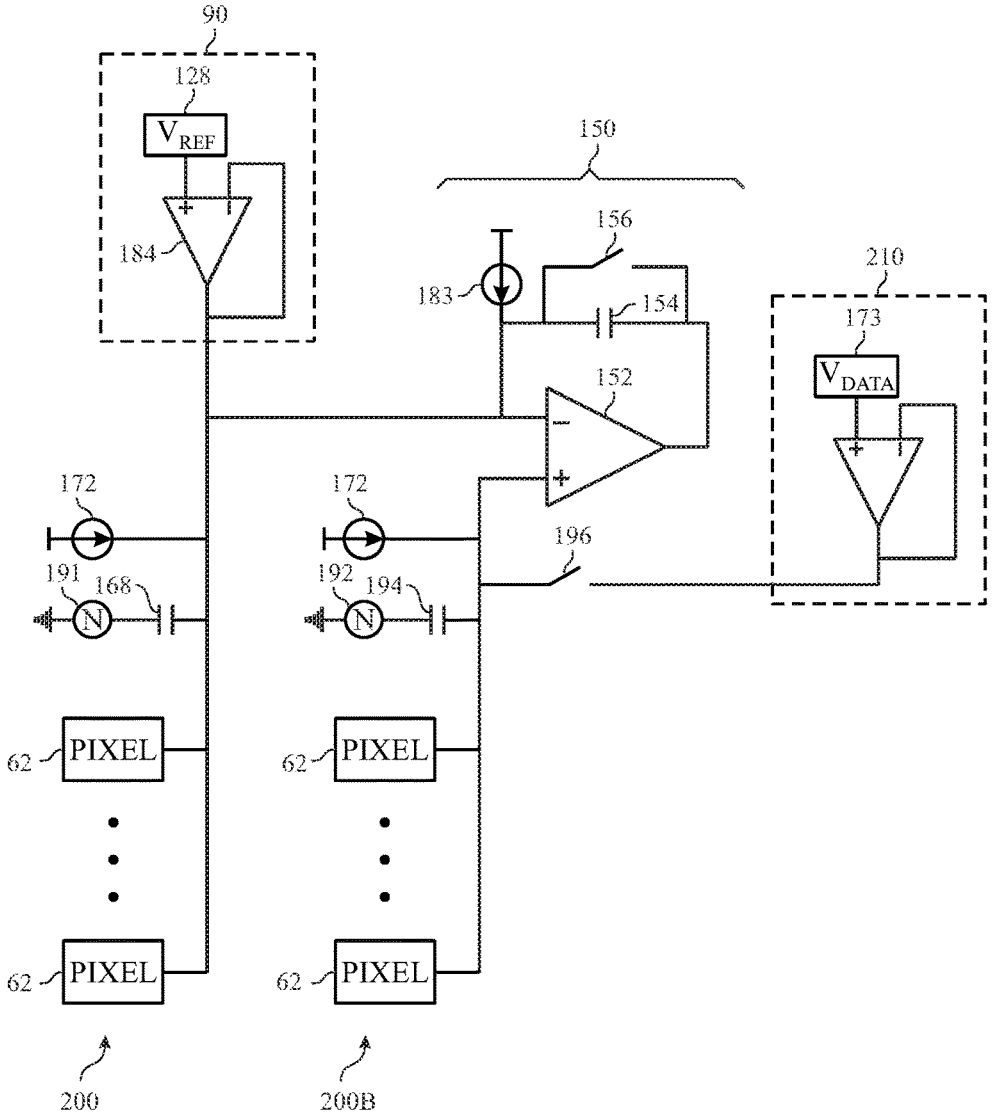
FIG. 17 is a schematic diagram of the sensing channel of FIG. 10 including architecture that compensates for current leakage and panel ground noise, in accordance with an embodiment.

FIG. 17 illustrates a portion of the sensing channel 150 including architecture that compensates for current leakage and panel ground noise, as discussed above. The sensing channel 150 may provide sensing for an individual column 200 of pixels 62 of the display 18. That is, each column 200 of pixels 62 in the display may include its own sensing channel 150 for measuring data from the pixel 62. Additionally, as illustrated, to provide the additional panel ground noise 192 to the positive terminal of the sensing amplifier 152, the panel ground noise 192 from a neighboring column 200B may be used. The additional panel ground noise 192 may be applied to a comparison voltage 173 stored on the additional line capacitor 194 and originating from a comparison voltage buffer 210.

Figure 18:
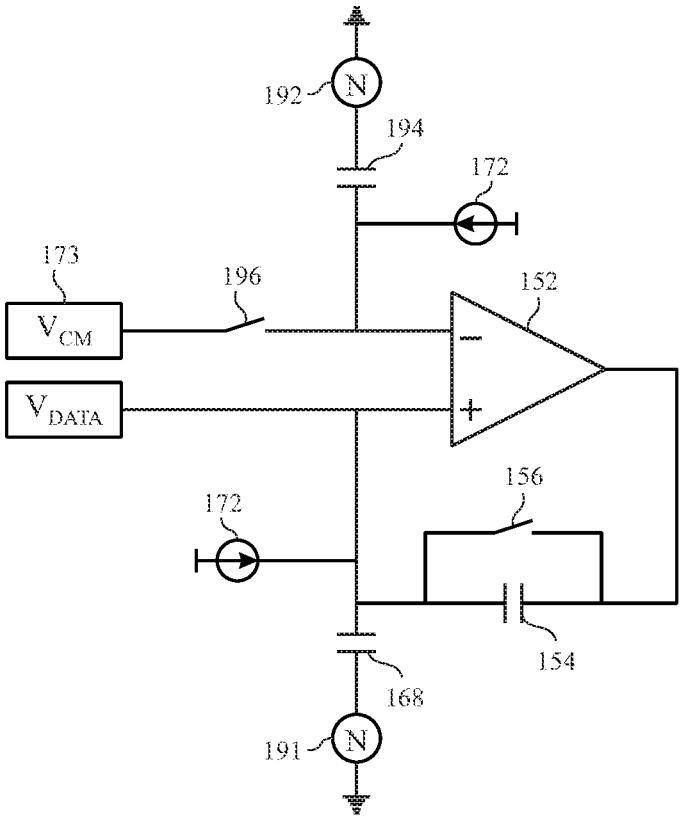
FIG. 18 is a schematic diagram of a portion of the sensing channel of FIG. 16 including the architecture that compensates for current leakage and common mode ground noise, in accordance with an embodiment.

Further, as illustrated in FIG. 18, it may also be appreciated that the current leakage 172 may be applied to the sensing amplifier 152 in a common mode on both the positive and the negative terminals of the sensing amplifier 152. Because the current leakage 172 is applied to the sensing amplifier 152 on both the positive terminal and the negative terminal of the sensing amplifier 152, the effects of the current leakage 172 are rejected by the sensing amplifier 152. Due to the cancellation of the effects of the current leakage 172, additional headroom to compensate for the current leakage 172 may also be avoided. Further, the correlated double sampling circuitry 176 may also be avoided with the application of the current leakage to both the positive and the negative terminals of the sensing amplifier 152. In particular, due to slight mismatches between the line capacitor 168 and 194, there may be a small percentage of ground noise amplified and provided to the output of the sensing amplifier 152 in relation to the percentage of ground noise amplified without a current leakage compensation scheme. In this manner, the headroom used to account for current leakage and panel ground noise may be reduced.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

a display panel comprising a plurality of pixels arranged in at least one row and at least one column;

an analog to digital converter; and a sensing channel comprising a sensing amplifier coupled to an integrated capacitor configured as an amplifier integrator, and coupled to the at least one column and to the analog to digital converter, wherein the sensing channel is configured to:

receive, in the amplifier integrator, a current from at least one of the plurality of pixels;

produce, by the amplifier integrator, a signal representative of the current from the at least one of the plurality of pixels;

compensate for current leakage of the display panel in the signal;

compensate for ground noise of the display panel in the signal; and after the compensation for the current leakage and the ground noise, provide the signal to the analog to digital converter for subsequent adjustment of the at least one of the plurality of pixels.

2. The electronic device of claim 1, wherein:

a negative terminal of the sensing amplifier is configured to receive the current from the at least one of the plurality of pixels; and a positive terminal of the sensing amplifier is configured to receive a voltage from a comparison voltage.

3. The electronic device of claim 1, comprising:

correlated double sampling circuitry coupled to the sensing amplifier, the correlated double sampling circuitry configured to compensate for the current leakage.

4. The electronic device of claim 3, comprising:

automatic gain control circuitry coupled to the correlated double sampling circuitry, the automatic gain control circuitry configured to control a gain of an output signal of the correlated double sampling circuitry to an expected level for the analog to digital converter, wherein an output of the automatic gain control circuitry comprises the signal provided to the analog to digital converter.

5. The electronic device of claim 1, comprising:

a data voltage source;

a data line coupling the data voltage source and the integrating capacitor;

a line capacitor coupled to the data line; and a set of switches that, when selectively configured, cause programming of the integrating capacitor by:

discharging the integrating capacitor; and charging the line capacitor to a voltage of the data voltage source.

6. The electronic device of claim 5, wherein:

the set of switches, when selectively configured, cause a signal representative of the current leakage to be provided to correlated double sampling circuitry.

7. The electronic device of claim 5, wherein:

the set of switches, when selectively configured, cause a signal representative of the current leakage combined with the pixel current to be provided to a correlated double sampling circuitry and the correlated double sampling circuitry is configured to isolate the pixel current, compensating for the current leakage.

8. The electronic device of claim 5, comprising:

a second line capacitor;

wherein the line capacitor is coupled to a negative terminal of the sensing amplifier and panel ground noise;

wherein the second line capacitor is coupled to a positive terminal of the sensing amplifier and second panel ground noise; and wherein the panel ground noise and the second panel ground noise cancel each other during integration of the sensing amplifier and the integrating capacitor.

9. The electronic device of claim 8, wherein:

the set of switches, when selectively configured, cause the second line capacitor to charge to a comparison voltage source, such that any change in the second panel ground noise is inputted to the positive terminal of the sensing amplifier.

10. The electronic device of claim 1, wherein a current leakage measurement is applied to a positive terminal of the sensing amplifier and a negative terminal of the sensing amplifier, such that effects of the current leakage are rejected by the sensing amplifier.

11. A hardware-circuitry implemented method, comprising:

programming a sensing channel configured to receive a current from a pixel, by discharging an integrating capacitor and charging a line capacitor using a data voltage source;

integrating leakage current from the pixel at a sensing amplifier and the integrating capacitor;

reprogramming the sensing channel by discharging the integrating capacitor and charging the line capacitor;

integrating pixel current from the pixel and the leakage current, using the sensing amplifier and integrating capacitor;

isolating the pixel current; and compensating for panel ground noise.

12. The method of claim 11, comprising triggering the programming of the sensing channel, by:

selectively closing:

a first switch of the integrating capacitor;

a second switch coupling the integrating capacitor with a data line; and a third switch coupling the data line with the data voltage source; and selectively opening:

a fourth switch coupling the integrating capacitor with correlated double sampling circuitry;

a fifth switch coupling the pixel current with the data line; and a sixth switch coupling a current leakage signal with data line.

13. The method of claim 12, comprising triggering the integrating the leakage current at the sensing channel and the integrating capacitor, by:

selectively closing:

the second switch;

the third switch;

the fourth switch; and the sixth switch; and selectively opening:

the first switch; and the fifth switch.

14. The method of claim 12, comprising triggering the reprogramming, by:

selectively closing:

the first switch;

the second switch; and the third switch; and selectively opening:

the fourth switch;

the fifth switch; and the sixth switch.

15. The method of claim 14, comprising triggering the integrating the pixel current and the leakage current, by:

selectively closing:

the second switch;

the fourth switch;

the third switch;

the fifth switch; and the sixth switch; and selectively opening:

the first switch.

16. Display panel compensation circuitry, comprising:

a sensing channel configured to receive a data signal from at least one pixel of a plurality of pixels of a display panel, wherein the data signal comprises a current received from the at least one pixel;

correlated double sampling circuitry configured to compensate for current leakage of the display panel in the data signal;

panel noise mitigation circuitry configured to reduce panel noise from the data signal;

circuitry that provides the data signal to an analog to digital converter after compensating for the current leakage and reducing the panel noise;

a sensing amplifier selectively coupleable to the correlated double sampling circuitry via a first switch between the sensing amplifier and the correlated double sampling circuitry;

an integrating capacitor selectively coupleable to a data line via a second switch between the integrating capacitor and the data line;

a pixel current source selectively coupleable to the data line via a third switch between the pixel current source and the data line; and a line capacitor coupled to a voltage data source via the data line.

17. The display panel compensation circuitry of claim 16, comprising:

a comparison voltage source coupled to a positive terminal of the sensing amplifier;

wherein the pixel current source, the voltage data source, and the integrating capacitor are configured to each be selectively coupled to a negative terminal of the sensing amplifier.

* * * * *